US008845078B2

(12) United States Patent
Owaki

(10) Patent No.: US 8,845,078 B2
(45) Date of Patent: Sep. 30, 2014

(54) LIQUID EJECTING HEAD MODULE AND LIQUID EJECTING APPARATUS

(71) Applicant: Seiko Epson Corporation, Tokyo (JP)

(72) Inventor: Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/018,594

(22) Filed: Sep. 5, 2013

(65) Prior Publication Data

US 2014/0002547 A1 Jan. 2, 2014

Related U.S. Application Data

(63) Continuation of application No. 13/198,538, filed on Aug. 4, 2011, now Pat. No. 8,550,598.

(30) Foreign Application Priority Data

Aug. 13, 2010 (JP) ..... 2010-181416

(51) Int. Cl.
*B41J 2/155* (2006.01)
*B41J 2/14* (2006.01)
*B41J 2/175* (2006.01)

(52) U.S. Cl.
CPC ..... *B41J 2/14201* (2013.01); *B41J 2/17553* (2013.01); *B41J 2/17513* (2013.01); *B41J 28/17523* (2013.01)
USPC ..... 347/42; 347/49

(58) Field of Classification Search
None
See application file for complete search history.

(56) References Cited

U.S. PATENT DOCUMENTS

| | | | |
|---|---|---|---|
| 6,450,614 | B1 | 9/2002 | Scheffelin et al. |
| 8,096,640 | B2 | 1/2012 | Blair et al. |
| 2004/0060969 | A1 | 4/2004 | Imai et al. |
| 2005/0206692 | A1 | 9/2005 | Sanpei et al. |
| 2006/0203040 | A1 | 9/2006 | Imai et al. |

FOREIGN PATENT DOCUMENTS

| | | |
|---|---|---|
| JP | 2002-086735 | 3/2002 |
| JP | 2004-90481 | 3/2004 |
| JP | 2006-111025 | 4/2006 |
| JP | 2007-038489 | 2/2007 |
| WO | WO 2004/022344 | 3/2004 |

OTHER PUBLICATIONS

U.S. Appl. No. 13/198,538, Mar. 4, 2013, Office Action.
U.S. Appl. No. 13/198,538, Jun. 24, 2013, Notice of Allowance.

*Primary Examiner* — Lamson Nguyen
(74) *Attorney, Agent, or Firm* — Workman Nydegger

(57) ABSTRACT

A liquid ejection head module is disclosed. The liquid ejection head module includes first and second head units disposed in a first direction. The first and second head units have first and second rows of liquid ejecting heads that have a plurality of nozzles disposed in the first direction. The first and second rows of liquid ejecting heads are disposed in a second direction crossing the first direction. The first and second head each have a projecting portion. A connector is disposed on each of the first and second head units and each connector is disposed so that the connecting port is open at a side opposite from a liquid ejecting side.

12 Claims, 12 Drawing Sheets

LIQUID EJECTING HEAD MODULE AND LIQUID EJECTING APPARATUS

This application is a continuation of U.S. application Ser. No. 13/198,538, filed Aug. 4, 2011, which claims priority to Japanese Patent Application No: 2010-181416, filed Aug. 13, 2010 which is expressly incorporated by reference herein.

BACKGROUND

1. Technical Field

The present invention relates to a liquid ejecting head module that includes a liquid ejecting head for ejecting liquid through a nozzle aperture and a liquid ejecting apparatus and, more particularly, the invention relates to an ink jet recording head module and an ink jet recording apparatus.

2. Related Art

A liquid ejecting apparatus typified by an ink jet recording apparatus such as an ink jet printer, an ink jet plotter or the like includes a liquid ejecting head that is capable of ejecting a liquid such as ink or the like contained in an ink cartridge, an ink container or the like as liquid droplets.

Regarding the liquid ejecting head used as a single unit for the aforementioned liquid ejecting apparatus, it is difficult to extend nozzle apertures, i.e., increase the number of nozzle apertures, and to achieve high-density nozzle apertures due to the increased manufacturing cost thereof as well as impairment of yield thereof in a manufacturing process that is caused by an increase in size thereof. In view of such circumstances, e.g., WO 2004/022344 discloses a unitized liquid ejecting head unit, hereinafter referred to simply as a head unit, that includes a plurality of liquid ejecting heads held by a holder, which is a common plate therefor.

As regards the aforementioned head unit, an extended row of equally spaced nozzles can be formed in a first direction by staggering the liquid ejecting heads in the first direction. Incidentally, the liquid ejecting heads are staggered on the head unit as described above; more specifically, the plurality of the liquid ejecting heads are disposed side by side in the first direction in which the nozzle apertures are disposed side by side; and two rows formed by the plurality of the liquid ejecting heads disposed side by side in the first direction are further disposed side by side in a second direction that is perpendicular to the first direction in which the nozzle apertures are disposed side by side. The aforementioned two rows of the liquid ejecting heads disposed side by side in the second direction are slightly spaced apart from each other in the first direction. In addition to the above, as regards the two liquid ejecting heads disposed in contiguous relation to each other in the two rows, the nozzle apertures formed at an end of a first nozzle row disposed on a first liquid ejecting head and the other nozzle apertures formed at an end of a second nozzle row disposed on a second liquid ejecting head are configured to be aligned with each other in the first direction. Hereby, with the plurality of liquid ejecting heads, it is possible to consecutively form the nozzle rows by disposing the equally spaced nozzles side by side in the first direction, and it is further possible to perform printing across a wide area by utilizing the width of the consecutive nozzle rows.

Nevertheless, the needs arise for consecutively forming the extended equally spaced nozzle row in the first direction of the head unit to hold the plurality of the liquid ejecting heads to the common holder. However, in a case where any one of the liquid ejecting heads disposed on the head unit becomes faulty, it is necessary to dismount the head unit that has a faulty liquid ejecting head from the liquid ejecting apparatus and replace the faulty liquid ejecting head with a new one; as a result of the above, a problem of performing a complicated replacing process on the faulty liquid ejecting head arises. Incidentally, each liquid ejecting head of the head unit is connected to a liquid supplying tube, an electrical wiring or the like, and therefore, it is difficult to dismount only one faulty liquid ejecting head directly from the liquid ejecting apparatus. In addition, a new liquid ejecting head that replaces the faulty liquid ejecting head should be positioned relative to the nozzle apertures of the other liquid ejecting heads with high precision. Accordingly, it is necessary to dismount the head unit integrally formed with the plurality of the liquid ejecting heads, in which the faulty liquid ejecting head lies, from the liquid ejecting apparatus and replace the faulty integral head unit with a new one.

In addition to the above, the extended nozzle row that is extended beyond the length of the head unit without being limited to the length of the nozzle row on a single head unit is made possible by disposing the plurality of head units side by side and modularizing the plurality of head units without mounting numerous liquid ejecting heads on the single head unit. However, a problem concerning the aforementioned description is an increase in size of a head module in the second direction that is perpendicular to the first direction due to the head units having to be staggered in order to configure the nozzle row, in which the equally spaced nozzle apertures are disposed consecutively in the first direction.

Further, the nozzle rows of the head module, which have an increased size in the second direction, are disposed at a different position from each other in the second direction, therefore, another problem is that printing quality is impaired due to a deviation in a timing when liquid droplets, such as ink droplets, land on a recording medium to be printed and a color-difference caused by a difference in an amount of smearing of liquid on the recording medium to be printed.

The problems as described above exist in not only a head module provided with an ink jet recording head that ejects ink but also a liquid ejecting head module with a liquid ejecting head that ejects a liquid other than ink.

SUMMARY

An advantage of some aspects of the invention is that it provides a liquid ejecting head module and a liquid ejecting apparatus which are capable of decreasing in size and enhancing printing quality by disposing nozzle rows adjacent one another.

According to a first aspect of the invention for resolving the problems as described above, the liquid ejecting head module includes a plurality of holders; a plurality of head units, each of which has one of the plurality of holders, disposed side by side in a first direction; a plurality of liquid ejecting heads held by each holder and disposed side by side on each holder in the first direction; a plurality of nozzle apertures, through which liquid is ejected, formed on each liquid ejecting head; a plurality of projecting portions, each of which is provided with one of the plurality of liquid ejecting heads, formed at each opposite end of each holder of the plurality of head units disposed in contiguous relation to one another in the first direction; and a plurality of cut-off portions formed at each opposite end of each holder of the plurality of head units disposed in contiguous relation to one another in the first direction, wherein the plurality of head units disposed side by side in the first direction are further disposed in side by side parallel rows in a second direction that is perpendicular to the first direction, and the plurality of projecting portions and the plurality cut-off portions of the head units disposed in contiguous relation to one another in the first direction are disposed in mating relation to one another so that the liquid ejecting heads disposed on each opposite projecting portion formed at each contiguous ends of the head units are disposed in overlapping relation to one another in the second direction.

The above-mentioned first aspect of the invention permits a manufacturing yield to be enhanced and further permits the nozzle row to be extended by the plurality of the head units. In addition to the above, the plurality of head units can be disposed linearly in the first direction and can be further decreased in size by decreasing the width of the head unit in the second direction; and thereby negating the need to dispose the nozzle rows of the plurality of the head units at different positions from each other in the second direction, the first aspect of the invention is further capable of restraining a color difference, a stripe or the like caused by a difference in an amount of smearing of liquid due to a deviation in a timing when liquid droplets land on a recoding medium to be printed from occurring.

Incidentally, each head unit is provided with a connector that is electrically connected to an external wiring as well as the each liquid ejecting head. It is, therefore, preferable that the connector be disposed so as to be connected to the external wiring at a side opposite from a liquid ejecting side where the nozzle aperture of the liquid ejecting head is open. It is further preferable that the connector be disposed at the exterior of the head unit in the second direction in which the liquid ejecting heads are disposed in side by side parallel rows. Thereby, the connector is disposed in an exterior region where the liquid ejecting head is disposed, it becomes possible to partition off the head unit into the region where the liquid ejecting head is disposed in the second direction and the exterior region where the connector is disposed; accordingly, it further becomes possible to easily arrange a tube for supplying a liquid to the liquid ejecting head, the external wiring that is connected to the connector or the like, and to decrease in size.

What is more, as regards the connectors which lie between the two adjacent rows of the head units, it is furthermore preferable that one connector of a first row of the head units and the other connector of a second row of the head units be disposed so as to be spaced apart from each other in the first direction; wherein the plurality of the head units disposed side by side in the first direction are disposed in side by side adjacent rows in the second direction. Hereby, in a case where the rows of the plurality of head units disposed side by side in the first direction are disposed side by side in the second direction, the row of the plurality of head units can be further decreased in size in the second direction, because the connectors of the adjacent rows of the head units will not interfere one another.

In addition to the above, it is furthermore preferable that a boundary of the holder between the region where the connector is disposed and the nozzle apertures side be a thin wall portion of which the thickness is smaller than those of another regions. By forming the thin wall portion as described above, it hereby becomes possible to suppress deleterious effects of applied force to the region where each liquid ejecting head is held, by causing only the region where the connector is disposed to undergo elastic deformation caused by applied force to the connector when the external wiring is connected to the connector and disconnected therefrom.

Further, it is still furthermore preferable that a space be formed between the holder and a substrate on which the connector is disposed. By forming a space therebetween, it hereby becomes possible to suppress deleterious effects of applied force to the region where the liquid ejecting head is held, because the region of the holder where the connector is disposed will not undergo elastic deformation caused by applied force to the connector when the external wiring is connected to the connector and disconnected therefrom.

Furthermore, according another aspects of the invention, a liquid ejecting apparatus includes the liquid ejecting head module in accordance with the aspects of the invention as describe above. The above-mentioned another aspects of the invention are capable of providing the liquid ejecting apparatus that can perform printing on a large sized recording medium to be printed and can be further decreased in size.

BRIEF DESCRIPTION OF THE DRAWINGS

The invention will be described with reference to the accompanying drawings, wherein like numbers reference like elements.

DESCRIPTION OF EXEMPLARY EMBODIMENTS

The present invention will be hereinbelow described in detail according to preferred embodiments.

First Embodiment

First, an ink jet recording head unit, hereinafter referred to simply as a head unit, an example of a liquid ejecting head unit according to a first embodiment of the invention, will be hereinbelow described. Here, FIG. 1 is an exploded perspective view of the ink jet recording head unit and FIG. 2 is an assembled cross-sectional view thereof.

Figure 1:
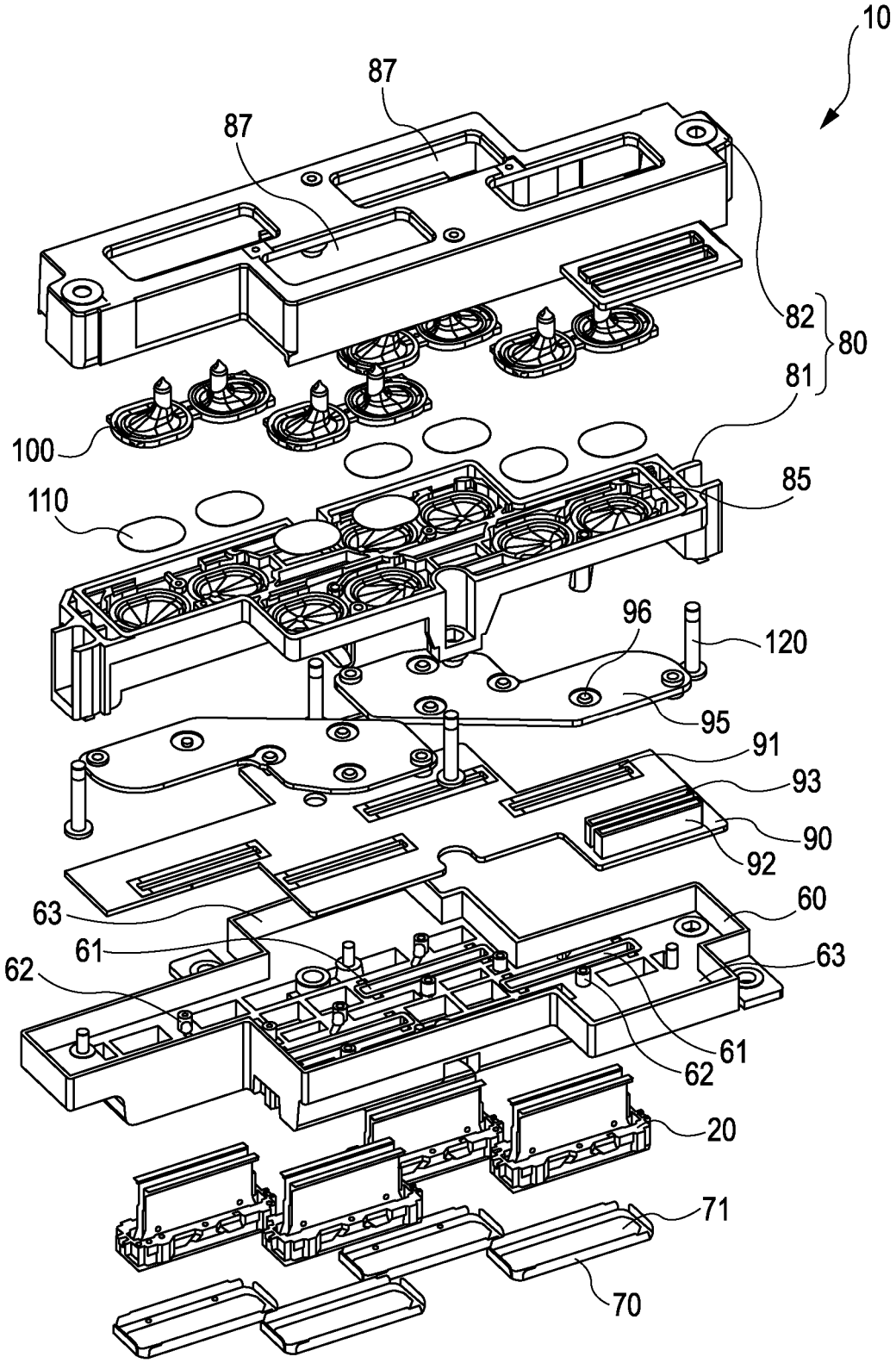
FIG. 1 is an exploded perspective view of a head unit according to a first embodiment of the invention.
Figure 2:
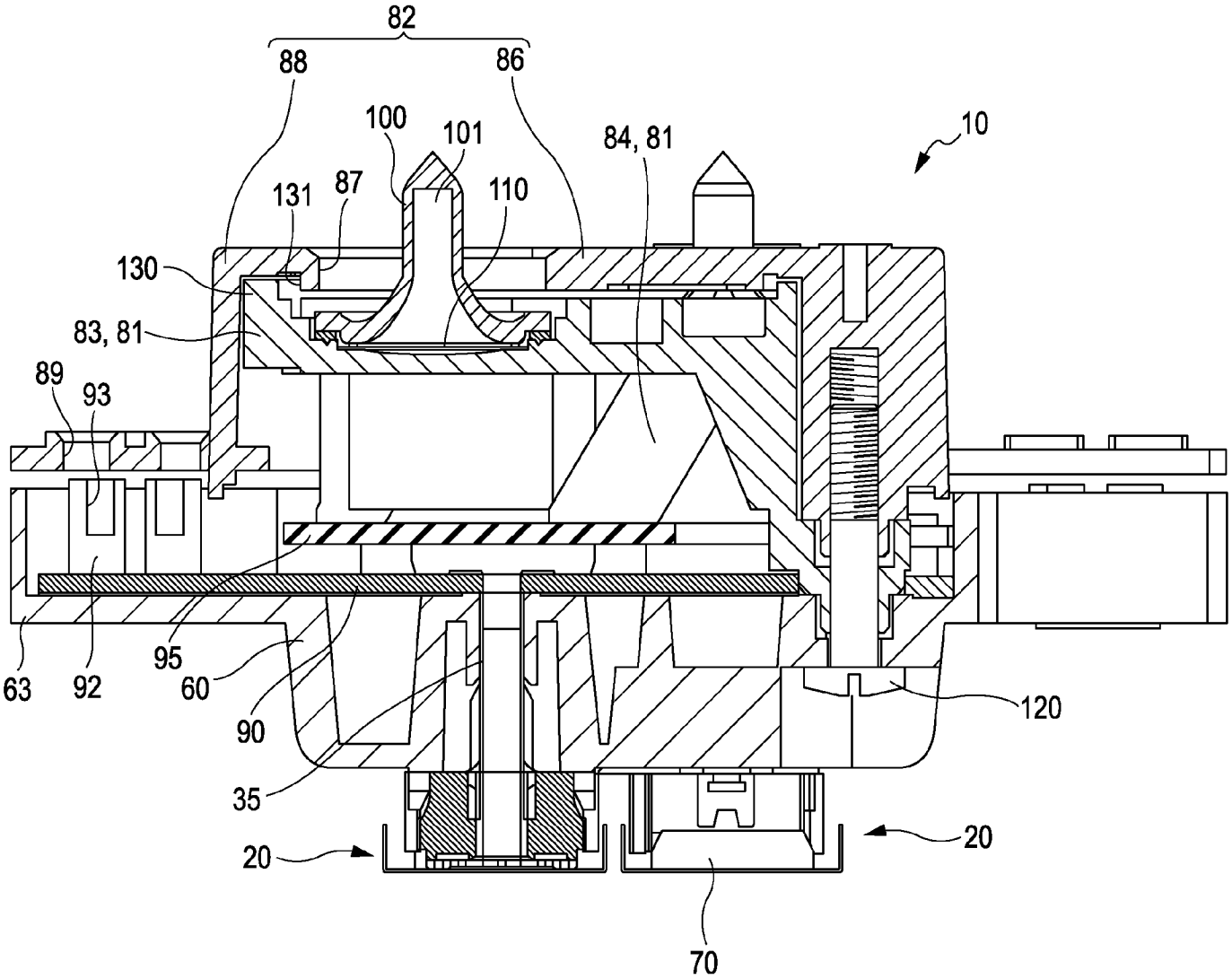
FIG. 2 is an assembled cross-sectional view of the head unit according to the first embodiment of the invention.

As illustrated in FIGS. 1 and 2, a head unit 10 includes a plurality of recording heads 20 for ejecting ink droplets; a case 60 as a holder for holding the recording head 20 thereto; a fluid passage member 80 disposed on a side of the case 60 opposite from the recording head 20; and a circuit substrate 90 disposed between the case 60 and the fluid passage member 80.

Figure 3:
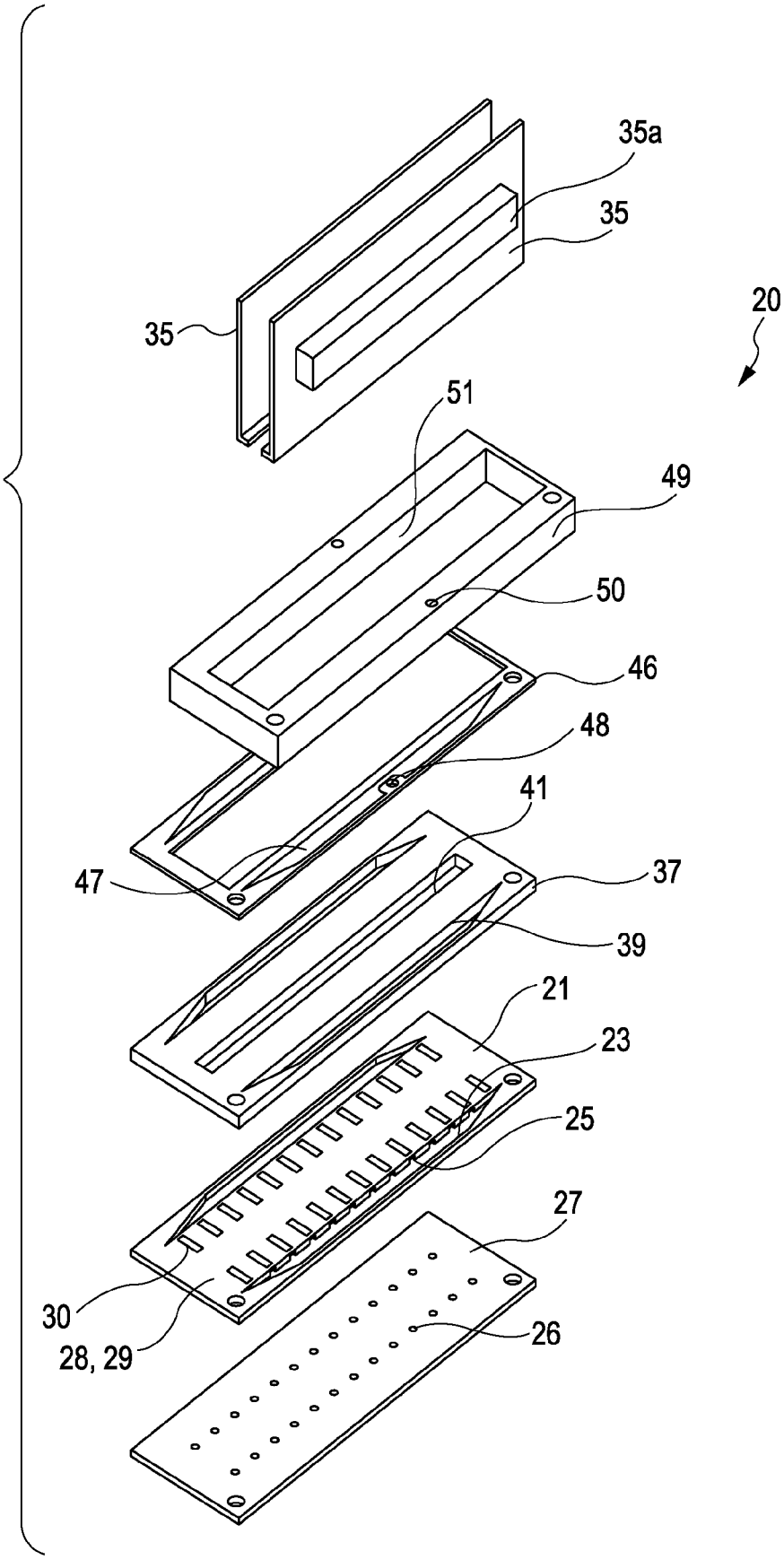
FIG. 3 is an exploded perspective view of a recording head according to the first embodiment of the invention.
Figure 4:
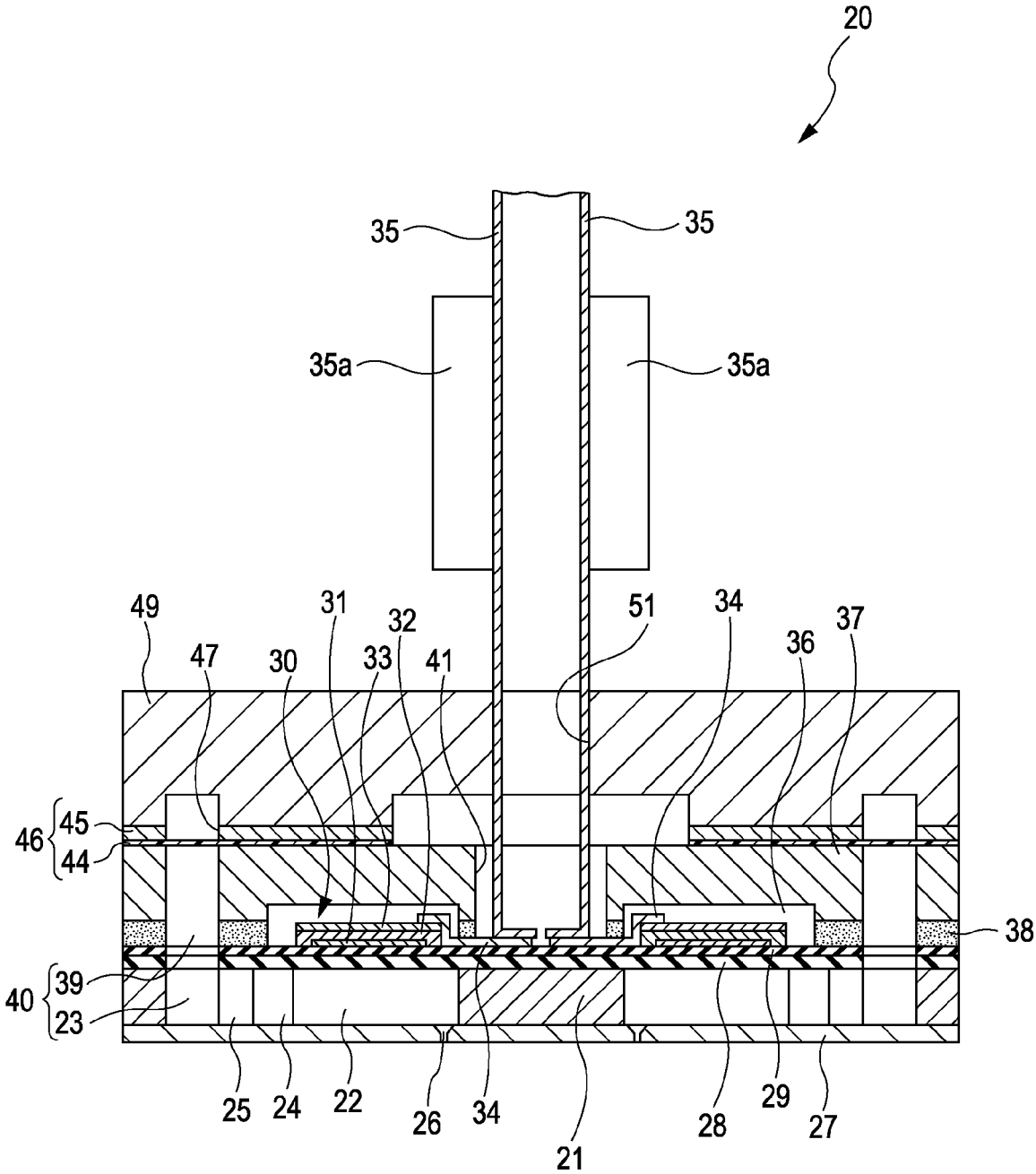
FIG. 4 is an assembled cross-sectional view of the recording head according to the first embodiment of the invention.

Reference is hereby made to FIGS. 3 and 4 to describe an example of a configuration of the recording head 20 to begin with. Here, FIG. 3 is an assembled perspective view of the recording head 20 according to the first embodiment of the invention and FIG. 4 is a cross-sectional view of a pressure generating chamber 22 of the recording head 20 in the longitudinal direction thereof.

As illustrated in FIGS. 3 and 4, a fluid passage forming substrate 21 that forms the recording head 20 includes a plurality of the pressure generating chambers 22 disposed in side by side two rows in the lateral direction thereof. In addition, a communicating portion 23 is formed in a longitudinal exterior region of each pressure generating chamber 22 of the row, wherein the communicating portion 23 and each pressure generating chamber 22 communicate with each other through an ink supplying passage 24 and a communicating passage 25 disposed in every pressure generating chamber 22.

A nozzle plate 27 includes a nozzle opening 26 that extends therethrough and communicates with each corresponding pressure generating chamber 22 in the vicinity of an end of the pressure generating chamber 22 opposite from the ink supplying passage 24, and the nozzle plate 27 is bonded to one side of the fluid passage forming substrate 21.

On the other hand, piezoelectric elements 30 are formed on the other side of the fluid passage forming substrate 21 opposite from the nozzle plate 27 through an elastic film 28 and an insulator film 29. Each of the piezoelectric elements 30 includes a first electrode 31, a piezoelectric body layer 32 and a second electrode 33. The second electrode 33 that forms each of the piezoelectric elements 30 is connected to a lead electrode 34 that extends over the insulator film 29. The lead electrode 34 is connected to the second electrode 33 at a first end thereof, and is further connected to a driving wiring 35 composed of a flexible wiring member, i.e., a COF substrate, that is provided with a driving IC 35*a* for driving the piezoelectric elements 30 at a second end thereof. Thus, the driving wiring 35 is connected to the lead electrode 34 at a first end thereof and is secured to the circuit substrate 90 at a second end thereof, refer to FIG. 2.

A protective substrate 37 that is provided with piezoelectric elements retainers 36, which are spaces for protecting the piezoelectric elements 30, in a region opposite to the piezoelectric elements 30 is bonded to a surface of the fluid passage forming substrate 21, on which the aforementioned piezoelectric elements 30 are formed, by means of an adhesive agent 38. In addition to the above, the protective substrate 37 is provided with manifold portions 39. According to the first embodiment of the invention, the manifold portions 39, which communicate with the communicating ports 23 of the fluid passage forming substrate 21, form manifolds 40, i.e., a common ink chamber for each pressure generating chamber 22.

Further, the protective substrate 37 is provided with a through hole 41 that is formed in the thickness direction thereof. The through hole 41 is disposed between the two piezoelectric elements retainers 36 according to the first embodiment of the invention. In addition, the lead electrode 34 that extends from each piezoelectric elements 30 is disposed such that a vicinity of one end of the lead electrode 34 is exposed through the through hole 41.

Furthermore, a compliance substrate 46 that includes a sealing film 44 and a fixing plate 45 is bonded to an upper surface of the protective substrate 37. The sealing film 44 is composed of a material that possesses low stiffness and flexibility, and one side of the manifold portion 39 is sealed with the sealing film 44. Furthermore, the fixing plate 45 is made of a hard material such as metal. Since a region of the fixing plate 45 opposite to the manifold 40 is completely bored through in the direction of thickness thereof so as to form an opening portion 47, one side of the manifold 40 is sealed with only the flexible sealing film 44. In addition to the above, the compliance substrate 46 is provided with an ink lead-in port 48 so as to guide ink into the manifold 40.

A head case 49 is secured to the compliance substrate 46. The head case 49 is provided with an ink lead-in passage 50 that communicates with the ink lead-in port 48 and supplies ink to the manifold 40 from a container such as a cartridge. The head case 49 is further provided with a wiring member retaining hole 51 that communicates with the through hole 41 formed through the protective substrate 37. The driving wiring 35 disposed through the wiring member retaining hole 51 is connected to the lead electrode 34 at one end thereof.

Each recording head 20 formed as described above is secured to the case 60. As illustrated in FIGS. 1 and 2, a plurality of the recording heads 20, four recording heads 20 according to the first embodiment of the invention, are secured to a bottom surface of the case 60. Hereby, an extended row of equally spaced nozzles can be formed in a first direction by staggering the plurality of recording heads 20 in the first direction. The plurality of recording heads 20 are staggered as described above, that is; the plurality of the recording heads 20 are disposed side by side in the first direction in which the nozzle apertures 26 are disposed side by side; and two rows which include the plurality of the recording heads 20, two recording heads 20 per one row, are spaced apart from each other in a second direction that is perpendicular to the direction, i.e. the first direction, in which the nozzle apertures 26 are disposed side by side. The aforementioned two rows of the recording heads 20 disposed side by side in the second direction are so disposed that they are slightly spaced apart from each another in the first direction. In addition to the above, as regards the two adjacent rows of the recording heads 20, the nozzle apertures 26 formed at one end of a first nozzle row of the recording heads 20 and the other nozzle apertures 26 formed at the other end of a second nozzle row thereof are configured so as to be aligned with each other in the first direction in which the nozzle apertures 26 are disposed side by side. Hereby, with the plurality of the recording heads 20, four recording heads 20 according to the first embodiment of the invention, it is possible for the nozzle row to be formed consecutively by disposing the equally spaced nozzle apertures 26 side by side so as to be extended as long as the length of four recording heads 20 in the first direction; as a result of the above, it is further possible to perform printing across a wide area by utilizing the width of the consecutive nozzle row.

The case 60 that retains the recording head 20 as described above is rectangularly shaped, when viewing a top thereof from a cover 82, and is further shaped in such manner that a pair of diagonal corners thereof appear to have been cut off. The case 60 is rectangularly shaped such that long sides of the rectangle extend along the above-mentioned first direction according to the first embodiment of the invention.

Incidentally, the case 60 is rectangularly shaped in such manner that a pair of diagonal corners thereof appear to have been cut off; that will be hereinbelow described.

As regards the case 60, a projecting portion and a cut-off portion, which are rectangularly shaped when viewed from above and formed at each end thereof in the longitudinal direction, are disposed side by side in the lateral direction. The projecting portion and the cut-off portion are further disposed so as to be directly opposite each other at each end of the case 60 in the longitudinal direction. The aforementioned cut-off portions are shaped such that the pair of diagonal corners of the case 60 appear to have been cut off as described above. The projecting portion and the cut-off portion will be later described in detail.

In addition, the case 60 includes extending portions 63 disposed on both long sides thereof in such manner that the partial long sides extend outwardly in the direction of short sides. More specifically, the case 60 includes the extending portions 63 disposed extendedly on both long sides in the second direction. A connector 92 of a circuit substrate 90, which will be later described in detail, is oppositely disposed relative to the extending portion 63.

The case 60 is further provided with through holes 61, which are formed therethrough in the thickness direction thereof and correspond to each recording heads 20. A supply passage 62, which communicates with the ink lead-in passage 50 disposed in the head case 49 of the recording head 20, is disposed on the exterior of the through hole 61 of the case 60. Furthermore, the driving wirings 35 of each recording head 20 are disposed through the through hole 61; the head case 49 of each recording head 20 is joined to an outer peripheral portion of the through hole 61 with a communication state between the ink lead-in passage 50 and a supply passage 62.

Incidentally, a cover head 70 provided with an opening 71, through which the nozzle apertures 26 are exposed, is secured to a bottom side of the nozzle plate 27 of each recording head 20 secured to the case 60.

The fluid passage member 80 is secured to a side of the case 60 opposite from the recording head 20 through the circuit substrate 90 and a sealing member 95 that is composed of a material such as rubber.

The circuit substrate 90 includes a plate-shaped member, on which electric components for driving the piezoelectric elements 30 and various kinds of wirings are mounted, which are not illustrated particularly. The circuit substrate 90 is further provided with a connecting hole 91 that is disposed therethrough in the thickness direction. In addition, the driving wirings 35 of each recording head 20 are disposed through the connecting hole 91, and ends of the driving wirings 35 are electrically connected to the various kinds of wirings or the like.

In addition to the above, the circuit substrate 90 is substantially rectangularly shaped, when viewed from above, and is further shaped in such manner that a pair of diagonal corners thereof appear to have been cut off. The circuit substrate 90 is further shaped in such manner that long sides of the rectangle extend along the direction of short sides thereof; i.e., the circuit substrate 90 is shaped similarly to the case 60 and an outside shape of the circuit substrate 90 is slightly smaller in size than that of the case 60. The circuit substrate 90 is further provided with the connectors 92 disposed on portions extended outwardly from both long sides of the rectangle thereof.

The connector 92 is secured to the circuit substrate 90 so that a connecting port 93, to which an external wiring is connected and from which the external wiring is disconnected, is open towards the fluid passage member 80 as illustrated in FIG. 1.

The fluid passage member 80 includes a main body of the fluid passage member 81 and the cover 82. The aforementioned circuit substrate 90 and the sealing member 95 are retained between the main body of the fluid passage member 81, which constitutes the fluid passage member 80, and the case 60.

In addition to the above, the main body of the fluid passage member 81 includes a securing member 83 and a fluid passage forming member 84 that is disposed so as to project downwardly from a bottom side of the securing member 83; a plurality of ink supply needles 100 are secured to one side of the securing member 83; and ink supply tubes connected to an ink container that contains ink are secured to the plurality of ink supply needles. An ink supply aperture 85 that is open at one end thereof opposite to the ink supply needle 100 is formed in each fluid passage forming member 84. Additionally, the other end of the ink supply aperture 85 is connected to the supply passage 62 of the case 60 through a supply communicating passage 96 disposed in the sealing member 95.

Further, the main body of the fluid passage member 81 substantially has a rectangular shape that coincides with the rectangular shape of the case 60 excluding the connectors 92 when viewed from above; i.e., the main body of the fluid passage member 81 is substantially rectangularly shaped in such manner that a pair of diagonal corners thereof appear to have been cut off when viewed from above. Hereby, portions where the connectors 92 of the circuit substrate 90 are disposed will not be covered by the main body of the fluid passage member 81 upon securing the main body of the fluid passage member 81 to the case 60.

Incidentally, a filter 110 for removing air bubbles and foreign substances from ink is disposed at an opening portion of one end of the ink supply aperture 85; i.e., the ink supply needle 100 is secured to the securing member 83 of the main body of the fluid passage member 81 through the aforementioned filter 110.

Each ink supply needle 100 is provided with a through passage 101 that communicates with the ink supply aperture 85 therewithin. Further, it is configured such that ink from the ink container is supplied to the manifold 40 of the recording head 20 through the ink supply tube, not illustrated, the through passage 101 of the ink supply needle 100, the ink supply aperture 85, the ink supply passage 62 or the like, by inserting the ink supply needle 100 into the ink supply tube.

The cover 82 substantially has a box-like-shape, of which an inferior surface side, i.e., the side opposite to the recording head 20, is open; the cover 82 is integrally attached to the main body of the fluid passage member 81 in such manner that the cover 82 overlaps the main body of the fluid passage member 81 from a side of the ink supply needle 100. The cover 82 is further shaped similarly to the case 60 when viewed from above; the cover 82 is furthermore similar in size to the case 60 when viewed from above; and the main body of the fluid passage member 81 and the circuit substrate 90 are included between the cover 82 and the case 60. More specifically, the cover 82 is provided with a bottom surface portion, which is a superior surface portion when viewed from below, 86 that is provided with an opening 87 for exposing the ink supply needle 100 therethrough and a wall portion 88, which is formed so as to enclose the fluid passage forming member 84 along a periphery thereof and upwardly extend to the case 60.

As illustrated in FIG. 2, the cover 82 and the case 60 are secured to each other by using a fastening member 120 such as a screw or the like under the following conditions; i.e., the aforementioned cover 82 overlaps the main body of the fluid passage member 81 from the ink supply needle 100 side, and the circuit substrate 90 and the sealing member 95 are interposed between the main body of the fluid passage member 81 and the casing 60. Hereby, the fluid passage member 80 is formed upon integrating the fluid passage member 81 with the cover 82; and furthermore, the fluid passage member 80 is integrated with the case 60. In accordance with the first embodiment of the invention, the fluid passage member 80 and the casing 60 are secured to each other by four fastening members 120 disposed on the individual sides thereof, refer to FIG. 1.

In the configuration of the recording head 20 according to the first embodiment of the present invention as described above, the circuit substrate 90, on which electronic components or the like for driving the piezoelectric elements 30 are mounted, is covered with the fluid passage member 80 and the case 60. More specifically, the circuit substrate 90 is accommodated in an intervening space formed between the cover 82 and case 60. Hereby, ink mist, which is generated by ejecting ink droplets through the nozzle aperture 26 of the recording head 20, can be efficiently prevented from adhering to the circuit substrate 90.

Incidentally, as described above, the circuit substrate 90 is provided with the connectors 92, which the external wirings, not illustrated, are connected. As illustrated in FIGS. 1 and 2, the connectors 92 are disposed at portions which project from opposite corners of the substantially rectangularly shaped circuit substrate 90. The connector 92 is further secured to the circuit substrate 90 so that the connecting port 93, to which and from which the external wiring is connected and disconnected, is open towards the fluid passage member 80 as illustrated in FIG. 2. An exposing opening 89 for exposing the connecting port 93 of the connector 92 therethrough is formed in a region opposite to the connector 92 of the cover 82 that constitutes the fluid passage member 80. Put another way, the connecting port 93 of the connector 92 can be connected to the external wiring and disconnected therefrom from the exterior of the fluid passage member 80 through the exposing opening 89.

Additionally, as described above, the case 60 and the fluid passage member 80 are secured to each other by using four fastening members 120 through the circuit substrate 90 that is interposed therebetween, refer to FIG. 1.

As regards the head unit 10 as described above, the plurality of head units 10 secured to a fixing member constitute an ink jet recording head module, one example of a liquid ejecting head module.

Figure 5:
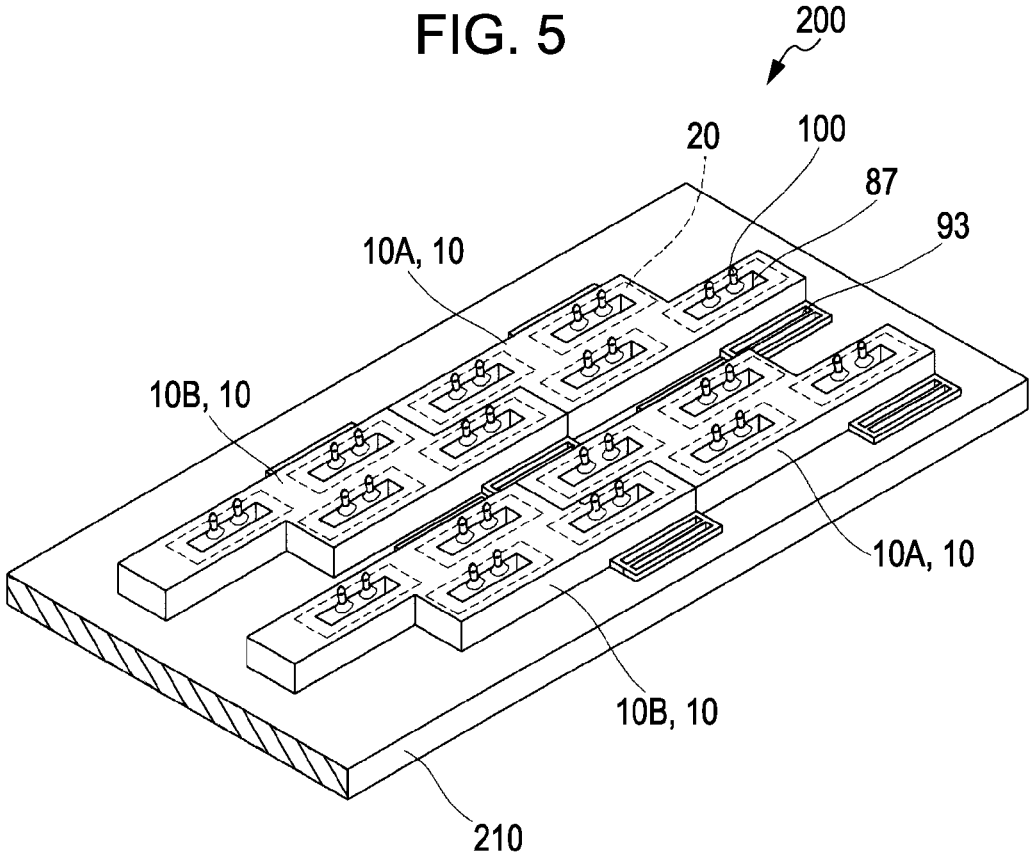
FIG. 5 is a schematic perspective view of a head module according to the first embodiment of the invention.
Figure 6:
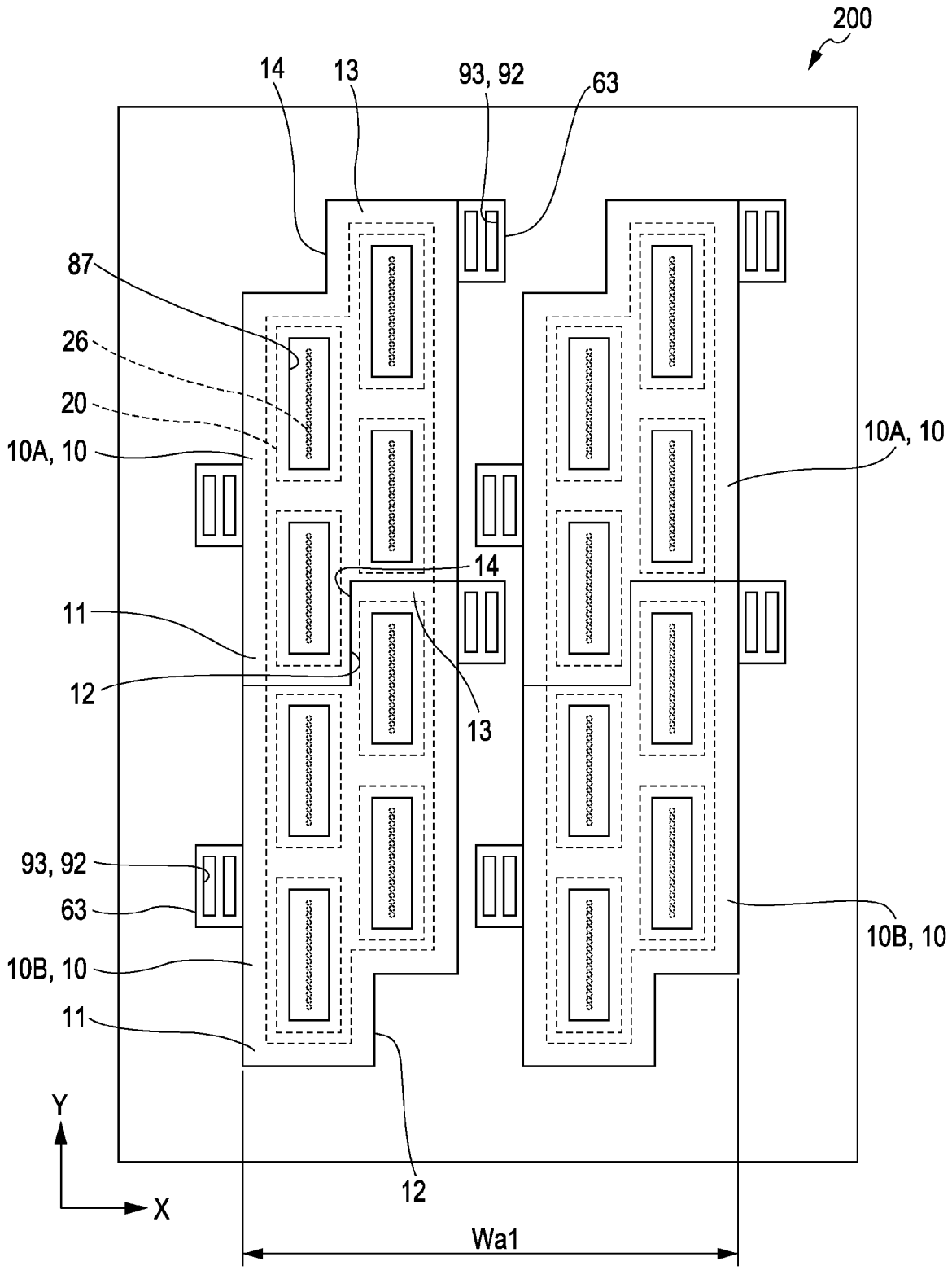
FIG. 6 is a plan view of the head module according to the first embodiment of the invention.
Figure 7:
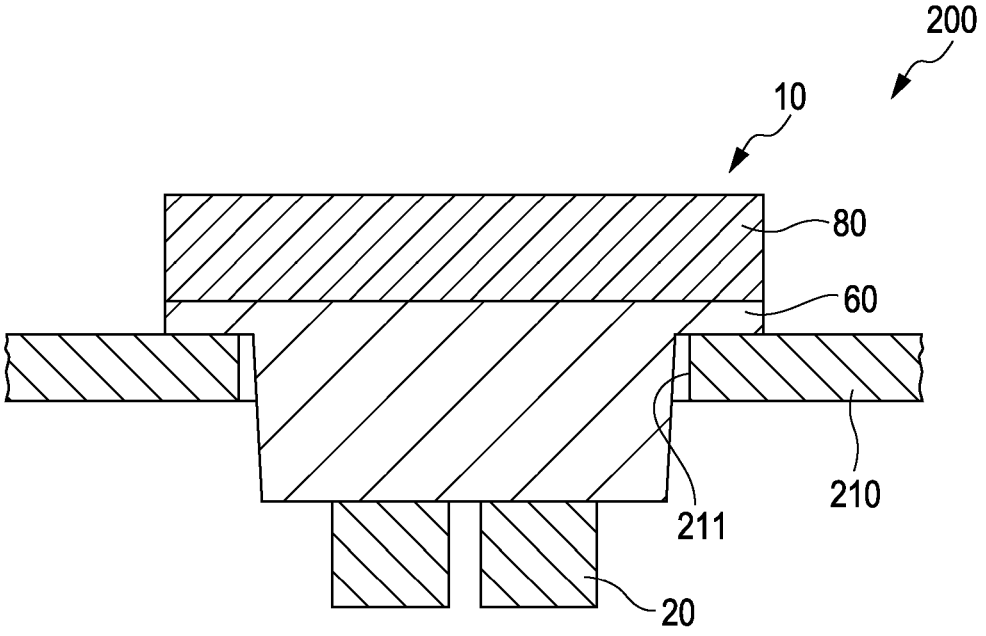
FIG. 7 is a schematic cross-sectional view of the head module according to the first embodiment of the invention.

The ink jet recording head module, hereinafter referred to simply as a head module, that is an example of the liquid ejecting head module according to the first embodiment of the invention will be hereinbelow described. For reference sake, FIG. 5 is a schematic perspective view illustrating the ink jet recording head module, which is an example of the liquid ejecting head module according to the first embodiment of the invention; FIG. 6 is a plan view of the head module; and FIG. 7 is a schematic cross-sectional view of the head module.

As illustrated in the above-mentioned drawings a head module 200 according to the first embodiment of the invention is provided with the plurality of the head units 10 and a fixing member 210 for fixing the plurality of the head units 10 thereto.

The fixing member 210 is composed of a plate-shaped member. As illustrated in FIG. 7, the fixing member 210 is provided with a fixing through hole 211, through which one end of the case 60 of the head unit 10 opposite to the recording head 20 and the recording head 20 are capable of being disposed when the head unit 10 is fixed to the fixing member 210. Since the fixing through hole 211 has a slightly smaller opening area than that of the other end of the case 60 opposite to the fluid passage member 80, an end surface of the case 60 abuts against a surface of the fixing member 210 in a state that only a portion of the case 60 opposite to the recording head 20 is disposed through the fixing through hole 211. Accordingly, the head unit 10 is fixed to the fixing member 210 in a state that the end surface of the case 60 abuts against the surface of the fixing member 210.

As described above, the head unit 10 has a rectangular shape with a pair of diagonal cut-off corners, when viewed from above, i.e., viewed from the side opposite from the fixing member 210.

The detailed shape of the head unit 10 will be hereinbelow described. The head unit module 200 according to the first embodiment of the invention is provided with the head units 10 linearly disposed side by side in the first direction Y. In addition to the above, projecting portions, 11 and 13, and cut-off portions, 12 and 14, are formed at individual opposite corners of a holder, such as the case 60 or the fluid passage member 80, for the head units 10 disposed in contiguous relation to each other in the first direction Y. More specifically, as regards the two head units disposed in contiguous relation to each other in the first direction Y, a first projecting portion 11 and a first cut-off portion 12 are disposed at a first end of a first head unit 10A that is contiguous to a second head unit 10B. On the other hand, a second projecting portion 13 and a second cut-off portion 14 are disposed at a second end of the second head unit 10B that is contiguous to the first head unit 10A.

Hereby, the first projecting portion 11 of the first head unit 10A is disposed so as to project towards the second head unit 10B with the first cut-off portion 12 that is formed by cutting a corner of the rectangularly shaped holder off in a rectangular shape. In other words, the first projecting portion 11 and the first cut-off portion 12 are disposed side by side in the second direction X. Likewise, the second projecting portion 13 of the second head unit 10B is disposed so as to project towards the first head unit 10A with the second cut-off portion 14 that is formed by cutting the corner of the rectangularly shaped holder off in the rectangular shape. In addition, a side by side arrangement of the first projecting portion 11 and the first cut-off portion 12 of the first head unit 10A and the side by side arrangement of the second projecting portion 13 and the second cut-off portion 14 of the second head unit 10B are opposite to each other. More specifically, as regards the two head units 10A and 10B contiguously disposed in the first direction Y, the second cut-off portion 14 of the second head unit 10B is oppositely disposed relative to the first projecting portion 11 of the first head unit 10A; likewise, the first cut-off portion 12 of the first head unit 10A is oppositely disposed relative to the second projecting portion 13 of the second head unit 10B.

The recording heads 20 are disposed on the aforementioned head units 10A and 10B in such manner that the nozzle apertures 26 are disposed side by side in the first direction Y. The rows of the recording heads 20 disposed side by side in the first direction Y are further disposed side by side in the second direction X, two rows according to the first embodiment of the invention, on the head units 10; a first row of the recording heads 20 is disposed so as to be spaced apart from a second row of the recording heads 20 in the first direction Y. More specifically, as regards the first head unit 10A, a first row of the recording heads 20 is displaced relative to a second row thereof in the first direction Y so as to dispose one recording head 20 on the first projecting portion 11. Likewise, as regards the second head unit 10B, a first row of the recording heads 20 is displaced relative to a second row thereof in the first direction Y so as to dispose one recording head 20 on the second projecting portion 13.

More specifically, as regards the respective head units 10A and 10B, since the first row of the recording heads 20 is displaced relative to the second row in the first direction Y, the first row of the recording heads 20 is disposed so as to project relative to the second row at first ends of the head units 10A and 10B in the first direction; while the second row of the recording heads 20 is disposed so as to project relative to the first row at second ends of the head units 10A and 10B. Thus, the cut-off portions 12 and 14 are disposed in spaces formed as a result of projecting of the first row of the recording heads 20; i.e., the cut-off portions 12 and 14 are disposed in regions formed as a result of retracting the second row of the recording heads 20 relative to the first row in the first direction Y.

In accordance with the first embodiment of the invention, as regards the head units 10A and 10B disposed in contiguous relation to each other in the first direction Y, the first projecting portion 11, the first cut-off portion 12, the second projecting portion 13 and the second cut-off portion 14 are further disposed respectively at second ends of the head units 10A and 10B opposite from the first ends where the head units 10A and 10B are oppositely disposed relative to each other. More specifically, the first projecting portion 11 and the first cut-off portion 12 are disposed at a first end where the first head unit 10A is contiguous with the second head unit 10B; while the second projecting portion 13 and the second cut-off portion 14 are disposed at a second end of the first head unit 10A opposite from the second head unit 10B in the first direction Y. Likewise, the second projecting portion 13 and the second cut-off portion 14 are disposed at a first end where the second head unit 10B is contiguous with the first head unit 10A; while the first projecting portion 11 and the first cut-off portion 12 are disposed at a second end of the second head unit 10B opposite from the first head unit 10A in the first direction Y. In other words, both first and second ends of the head units 10A and 10 B in the first direction Y have a rotationally symmetric configuration. Hereby, the positions of the head units 10A and 10B can be interchanged in the first direction Y relative to each other when the projecting portions, 11 and 13, and the cut-off portions, 12 and 14, are disposed in mating relation to each other upon disposing the head units 10 side by side in the first direction Y, this will be described in further detail later; as a consequence of the above, cost can be reduced by mass-producing the similarly shaped head units 10 in comparison with manufacturing of differently shaped head units.

In addition to the above, the head unit 10 extends outwardly as far as the connector 92 from both long sides thereof in the direction of short sides thereof, i.e., in the second direction X. The extending portion 63, which extends outwardly from a first long side of the head unit 10, is disposed at side of the first end thereof, as illustrated in the center of FIG. 6, in the first direction Y so as to be disposed at the side opposite from the first cut-off portion 12 in the second direction X. Further, the extending portion 63, which extends outwardly from a second long side of the head unit 10, is not disposed at side of the first end of the head unit in the first direction Y but at a position displaced from the first end thereof in the first direction Y towards the center along the second long side thereof so as to be disposed at the side opposite from the second projecting portion 14 in the second direction X.

In addition to the above, the row of the head units 10 is formed by disposing the above-mentioned head units 10A and 10B side by side in the first direction Y. The head units 10 are linearly disposed in the first direction Y according to the first embodiment of the invention. In such a case as described above, as regards the head units 10A and 10B disposed in contiguous relation to each other in the first direction Y, the recording heads 20, which are disposed at the individual projecting portions 11 and 13 of the contiguous head units 10A and 10B, are disposed in overlapping relation to each other in the second direction X by disposing the projecting portions 11 and 13, and the cut-off portions 12 and 14, in mating relations to each other.

More specifically, as regards the head units 10A and 10B disposed in contiguous relation to each other in the first direction Y, the first projecting portion 11 of the head unit 10A is disposed in mating relation with the second cut-off portion 14 of the head unit 10B. The second projecting portion 13 of the head unit 10B is likewise disposed in mating relation with the first cut-off portion 12 of the head unit 10A. Hereby, first projecting portion 11 is disposed in mating relation with the second cut-off portion 14; and in addition, the second projecting portion 13 is disposed in mating relation with the first cut-off portion 12. According to the first embodiment of the invention, what is described herein refers to the head units 10A and 10B disposed in contiguous relation to each other in the first direction Y with the projecting portions 11 and 13 and the cut-off portions 12 and 14 disposed in mating relation to one another.

Incidentally, an arrangement of the head units 10A and 10B disposed in mating relation to each other in the first embodiment of the invention, as described herein, refers to the head units 10A and 10B in a mutually mated condition with outer end shapes thereof, when viewed from above. In addition, since the head units 10A and 10B disposed in mating relation to each other in the first embodiment of the invention is defined as only mating relation between the outer end shapes of the head units 10A and 10B, the aforesaid definition allows, e.g., gaps to be provided therebetween.

The head units 10A and 10B can be linearly disposed side by side in the first direction Y by thus disposing the projecting portions and the cut-off portions thereof in mating relation to one another. For reference sake, the head units 10A and 10B disposed side by side in the first direction are herein referred to as the head units 10A and 10B, of which both two rows of the recording heads 20 disposed in substantially the same position in the second direction X. The head unit 10A and 10B, therefore, may be slightly spaced apart from each other in the second direction X.

Additionally, by disposing the recording heads 20 provided on the individual projecting portions of the head units 10A and 10B, which are disposed in contiguous relation to each other, in overlapping relation to one another in the second direction X, the nozzles rows of the first head unit 10A can be disposed in substantially the same position as the nozzles rows of the second head unit 10B in the second direction X; and in addition, the individual nozzles rows of the first head unit 10A and the second head unit 10B can be further consecutively disposed in the first direction Y. More specifically, the nozzles rows formed by the two rows of the recording heads 20 disposed on the first head unit 10A and the second head unit 10B can be disposed in substantially the same position in the second direction X. On account of the above, the head module 200 can be decreased in size without having to be increased in size in the second direction X. Adding to the above, since the two head units 10A and 10B can be linearly disposed side by side in the first direction Y, it becomes possible to enhance printing quality by restraining a timing when ink droplets ejected from the two head units 10 land on a recording medium to be printed from being deviated, and further by restraining a color-difference and a stripe caused by a difference in an amount of swearing of ink droplets on the recording medium to be printed from occurring.

Figure 8:
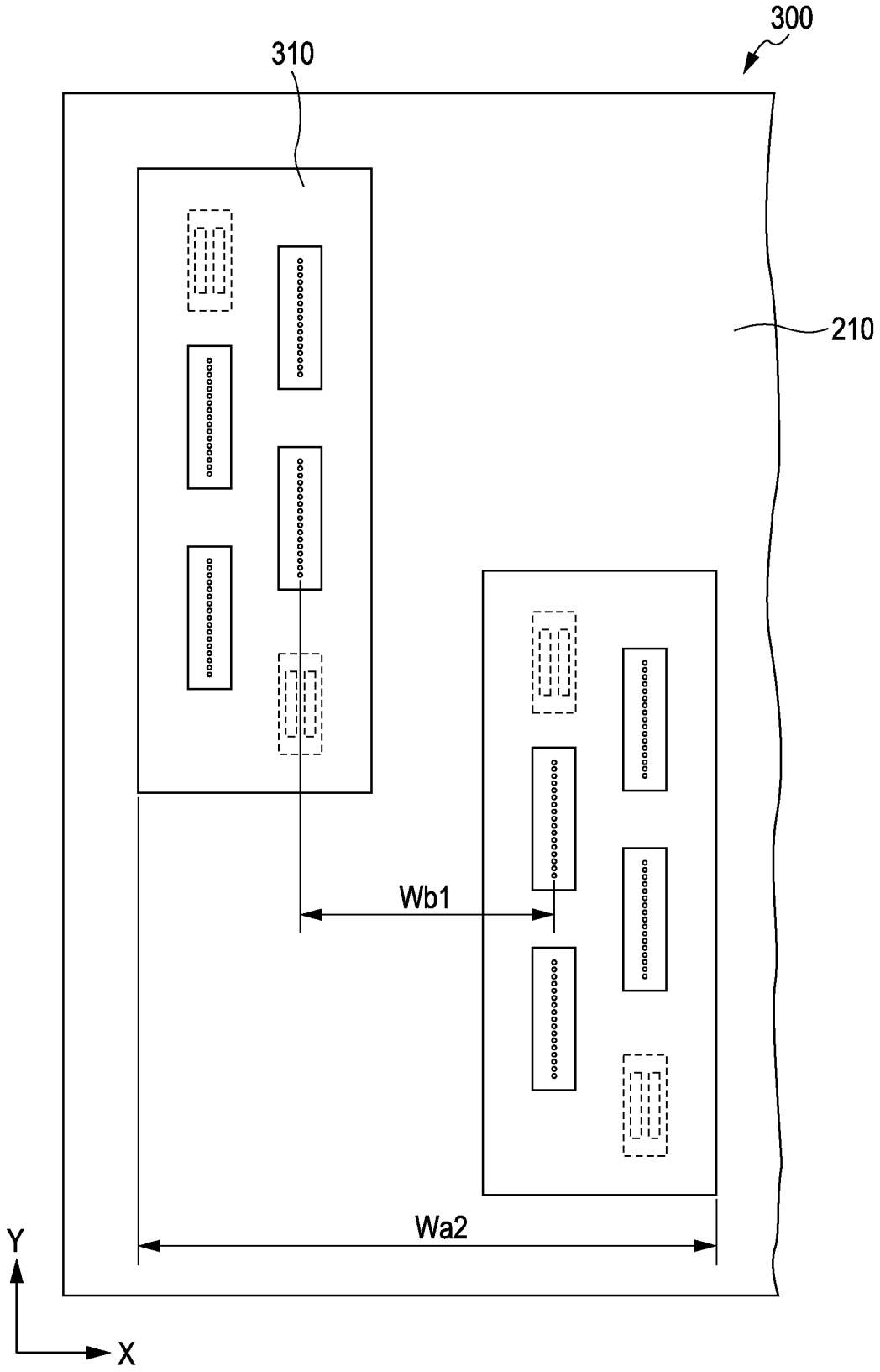
FIG. 8 is a plan view illustrating a conventional configuration of the head module.

Incidentally, as illustrated in FIG. 8, a conventional head unit 310, which is not provided with the projecting portions 11 and 13 and the cut-off portions 12 and 14, requires that the two head units 310 be spaced apart from each other in the second direction X so as to dispose the nozzles rows thereof in overlapping relation to one another in the first direction Y. In a case where the head units 310 are thus disposed, the width Wa2 of the two head units 310, which configure the nozzles rows consecutively disposed in the first direction Y, with a space interposed therebetween in the second direction X is increased to a considerable extent; and in addition, the two nozzles rows of the two head units 310 are spaced apart from each other by the width Wb1 in the second direction X. As a consequence of the above, the timing when ink droplets land on the recording medium to be printed is deviated and the color-difference and the stripe caused by the difference of in the amount of smearing of ink droplets on the recording medium to be printed occur; therefore, printing quality is impaired as a result of the above. In accordance with the first embodiment of the invention, by disposing the two head units 10, which configure the nozzles rows consecutively disposed in the first direction Y, the width Wa1 of two rows of the head units 10 in the second direction X can be narrower than the width Wa2 of two rows of the head units 310 with a space interposed therebetween; and moreover, a space interposed between the two nozzles rows disposed on the two head units 10 in the second direction X can be further eliminated.

In addition to the above, according to the first embodiment of the invention, the connectors 92 are disposed in regions which extend outwardly from both long sides of the head unit 10 along the second direction X as described above. More specifically, a first connector 92 is disposed at a side of the second projecting portion 13 of the head unit 10B opposite from the first cut-off portion 12 in the second direction X. Further, a second connector 92 is disposed at a side of the first cut-off portion 12 of the head unit 10B opposite from the second projecting portion 13 in the second direction X; however, a second connector 92 is disposed at a position displaced towards the center from the first end of the head unit 10B along the aforementioned side. The head units 10 can hereby be disposed side by side in the first direction Y so as to consecutively dispose the nozzles rows thereon without interference from the connectors 92. In addition, by disposing the connectors 92 at both outsides of the rows of the recording heads 20 in the second direction X, the rows of the head units 10 can be disposed in overlapping relation to each other in the first direction Y when the rows of the head units 10 disposed side by side in the first direction Y are further disposed side by side in the second direction X without overlapping of the connectors 92. More specifically, as regards the connectors 92 disposed between two opposite rows of the head units 10, the connectors 92 of the first row of the head units 10 and the second row of the head units 10 are spaced apart from one another in the first direction Y. Since the connectors 92 disposed between the rows of the head units 10 can be hereby arranged in overlapping relation to one another in the first direction Y, a space interposed between the two opposite rows of the head units 10 can be narrowed, and the head module 200 can be further decreased in size in the second direction X. What is more, by disposing the connectors 92 at the exterior of the rows of the recording heads 20 disposed on the individual head units 10, a first region where the plurality of the recording heads 20 is disposed in overlapping relation to one another and a second region where a plurality of the connectors 92 is disposed in overlapping relation to one another in the second direction X can be disposed in an alternating sequence. Accordingly, the ink tube or the like for supplying ink to the recording head 20 and the external wiring connected to the connector 92 can be easily disposed in the alternating sequence; and moreover, the ink tube and the external wiring can be bundled together, and can be consequently easily connected to the recording head 20 and the connector 92. In other words, while the recording head 20 is connected to the ink tube for supplying ink and the connector 92 is connected to the external wiring for supplying a printing signal thereto, it is hard to dispose the ink tube and the external wiring because a plurality of ink tubes are connected to the plurality of the recording heads 20. According to the first embodiment of the invention, a region where the recording heads 20 are disposed and a region where the connectors 92 are disposed can be partitioned off from each other in the second direction X. Hence, the ink tubes can extend longitudinally from the same position in the second direction X to the plurality of the recording heads 20 along the first direction Y. The external wiring can likewise extend longitudinally from the same position in the second direction X to the plurality of connectors 92 along the first direction Y. Accordingly, the plurality of the ink tubes and a plurality of the external wirings can be disposed in the bundled ink tubes and in the bundled external wirings respectively; as a result of a simplified arrangement of the ink tubes and the external wirings for the recording heads 20 and the connectors 92 as described above, the head module 200 can be decreased in size.

Figure 9:
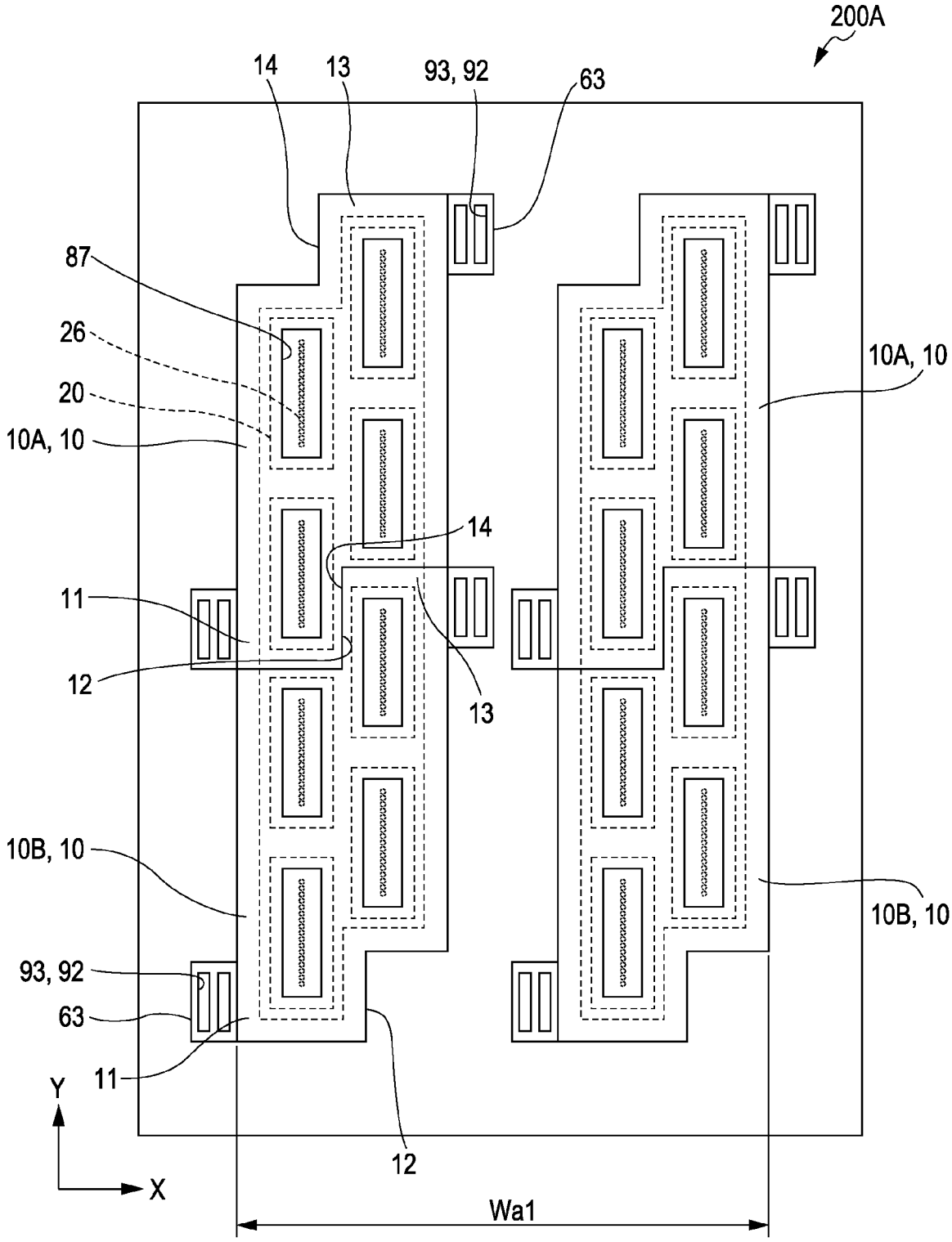
FIG. 9 is a plan view illustrating a modification of the head module according to the first embodiment of the invention.

Incidentally, the connectors 92 disposed between the rows of the head units 10 are arranged in overlapping relation to one another in the first direction Y according to the first embodiment of the invention, however, it should be understood that the invention is not particularly limited thereto. For instance, as illustrated in FIG. 9, the connectors 92 of the individual head units 10 of a head module 200A may be disposed at of both end sides thereof in the direction Y. In the aforementioned case, it is required that the connectors 92 be spaced a distance away from the positions thereof illustrated in FIG. 6 so as to avoid mutual overlapping of the connectors 92 when the two rows of the head units 10 are disposed side by side in the second direction X. However, such arrangement of the head units 10 as illustrated in FIG. 9 still permits the head module 200A to be decreased in size in comparison with an arrangement of the head units 10 as illustrated in FIG. 8. As a matter of course, in a case where only one row of the head units 10 is disposed on the head modules 200 and 200A in the second direction X, the head modules 200 and 200A can be similarly sized in the second direction regardless of the head unit 10 illustrated in FIG. 6 or the head unit 10 illustrated in FIG. 9.

Such head module 200 or head module 200A as described above is mounted on an ink jet recording apparatus, which is one example of a liquid ejecting apparatus. The ink jet recording apparatus will be hereinbelow described. Incidentally, FIG. 10 is a schematic cross-sectional view illustrating the ink jet recording apparatus, which is one example of the liquid ejecting apparatus, according to the first embodiment of the invention.

Figure 10:
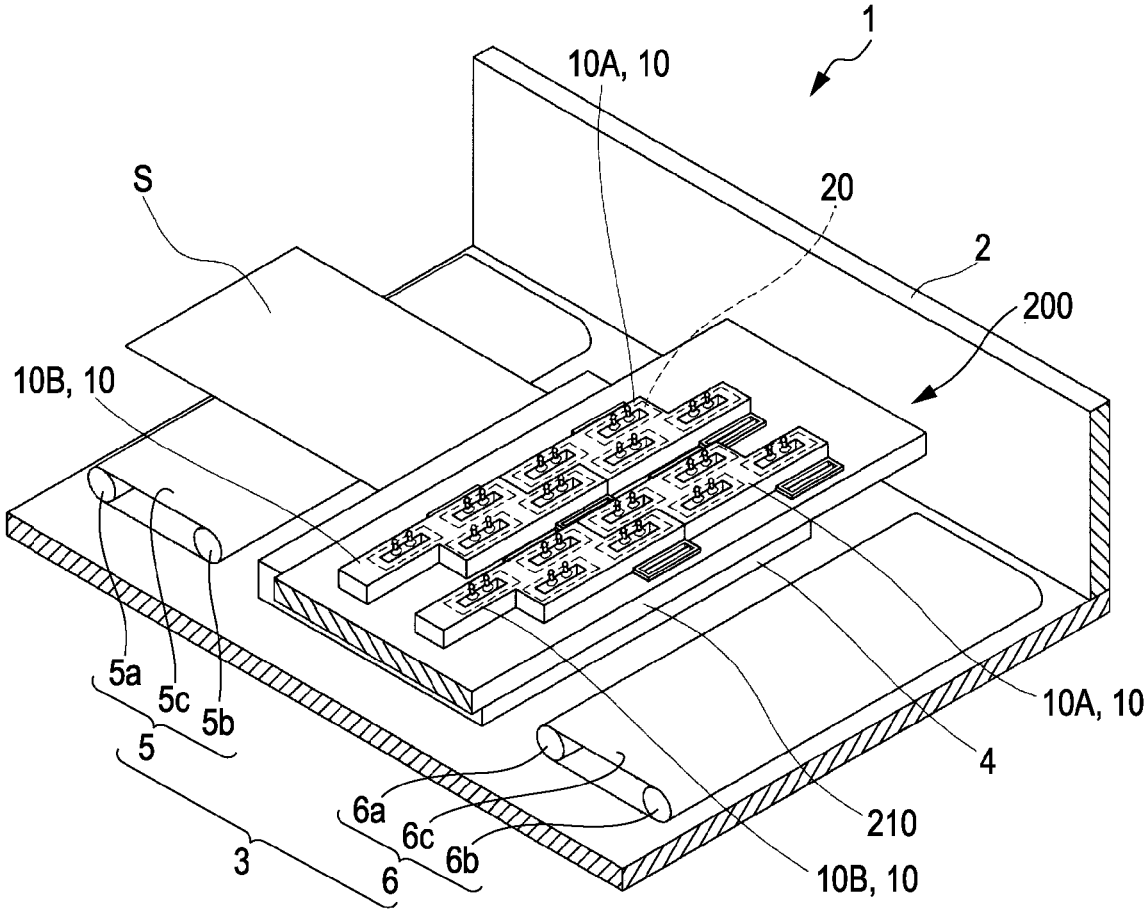
FIG. 10 is a schematic cross-sectional view of a recording apparatus according to the first embodiment of the invention.

According to the first embodiment of the invention, the ink jet recording apparatus, i.e., a so called line-type recording apparatus, to which the head module 200 is secured, performs printing by transporting a recording sheet S, which is a medium to be ejected such as a paper, as illustrated in FIG. 10.

More specifically, an ink jet recording apparatus 1 includes an apparatus body 2, the head module 200 secured to the apparatus body 2, a transporting means 3 for transporting the recording sheet S, i.e. the recording medium to be recorded, and a platen 4 that supports the recording sheet S on a back surface opposite from a printing surface oppositely disposed relative to the head module 200.

The head module 200 is secured to the apparatus body 2 in such manner that the first direction Y, refer to FIG. 6, in which the nozzle apertures 26 of the recording heads 20 are disposed side by side, is perpendicular to a transporting direction of the recording sheet S.

The transporting means 3 includes a first transporting means 5 and a second transporting means 6 which are disposed on both sides of the transporting direction of the recording sheet S relative to the head module 200.

The first transporting means 5 includes a driving roller 5*a*, a driven roller 5*b* and a transporting belt 5*c* wound around the aforementioned driven roller 5*a* and driven roller 5*b*. In addition to the above, the second transporting means 6 includes, similarly to the first transporting means 5, a driving roller 6*a*, a driver roller 6*b* and a transporting belt 6*c*.

The above-mentioned driving rollers 5*a* and 6*a* of the first transporting means 5 and the second transporting means 6 are connected to a driving means such as a driving motor or the like, not illustrated. The recording sheet S is transported at an upper stream side and a down stream side of the head module 200 by rotational driving of the transporting belts 5*c* and 6*c* driven by driving force of the driving means.

While the first transporting means 5 and the second transporting means 6, which include the driving rollers 5*a* and 6*a*, the driven rollers 5*b* and 6*b*, and the transporting belts 5*c* and 6*c*, have been hereinabove exemplified according to the first embodiment of the invention, a holder that holds the recording sheet S on the transporting belts 5*c* and 6*c* may be further provided thereto. As regards the holder, for instance, by providing a charging means that charges the exterior of the recording sheet S, the recording sheet S charged by the charging means may be adsorbed on the transporting belts 5*c* and 6*c* by the effect of dielectric polarization. Further, by providing a pressing roller on the transporting belts 5*c* and 6*c* as the holder, the recording sheet C may be pinched between the pressing roller and the transporting belts 5*c* and 6*c*.

The platen 4 composed of a metal, a resin or the like is disposed between the first transporting means 5 and the second transporting means 6 in such manner that a cross-sectional surface thereof oppositely disposed relative to the head module 200 is rectangularly shaped. The platen 4 supports the recording sheet C transported by the first transporting means 5 and the second transporting means 6 at an opposite position relative to the head module 200.

Further, the platen 4 may be provided with an adsorbing means that adsorbs the transported recording sheet C on the platen 4. The adsorbing means includes, e.g., an attracting means that attracts the recording sheet C with attraction force, an electrostatically adsorbing means that adsorbs the recording sheet C with electrostatic action thereto or the like, to name just a few.

In addition, an ink container, which is not illustrated, such as the ink container that contains ink therein, an ink cartridge that likewise contains ink therein or the like, is connected to the individual head units 10 of the head module 200 so as to be capable of supplying ink thereto. For instance, the ink container may be retained on the head module 200 or in a different position in the apparatus body 2 from that of the head module 200, and may be connected to thereto through the ink tube or the like. Each head unit 10 of the head module 200 is further connected to the external wiring, which is not illustrated.

As regards the ink jet recording apparatus 1 as described above, the transporting means 5 transports the recording sheet S, and the head module 200 subsequently performs printing on the recording sheet S supported on the platen 4. The transporting means 3 then transports the printed recording sheet S.

Another Embodiment

While the first embodiment of the invention has been hereinabove described, it should be understood that the fundamental constitution of the invention is not limited thereto.

For instance, the plurality of the head units 10 and the plate-shaped fixing member 210 for fixing the plurality of the head units 10 thereto are provided so as to configure the head module 200 according to the first embodiment of the invention as described above; however, e.g., the cases 60, which are holders for holding the head units 10 disposed in contiguous relation to each other in the first direction Y, may be fixed together in lieu of the fixing member 210 without being particularly limited thereto. As a matter of course, in a case where something corresponding to the fixing member 210 is provided to the apparatus body 2 of the ink jet recording apparatus 1, it may thereby negate the need to fix the cases 60 of the head module 200 together.

In addition to the above, for instance, the extending portions 63, which extend outwardly from the case 60 in the rectangular shape, are provided thereto, and the connectors 92 of the circuit substrate 90 are disposed on the extending portions 63 according to the first embodiment as described above; however, there arises the disadvantage of the possibility that the case 60 might be deformed by pushing force or pulling force applied to the portions where the connectors 92 of the circuit substrate 90 are disposed, when the external wirings are connected to the connectors 92 or disconnected therefrom; and, as a result of the above, the deformed case 60 might further result in deformation and misalignment of the recoding heads 20. As the countermeasures against the above described problems, the extending portions 63, which are oppositely disposed relative to the connectors 92 of the case 60, are configured so as to be elastically deformed relative to regions where the recording heads 20 are retained. An another embodiment of the present invention as described above is hereby illustrated in FIGS. 11A and 11B. Here, FIGS. 11A and 11B are cross-sectional views of substantial parts of a head unit according to the another embodiment of the invention.

Figure 11A:
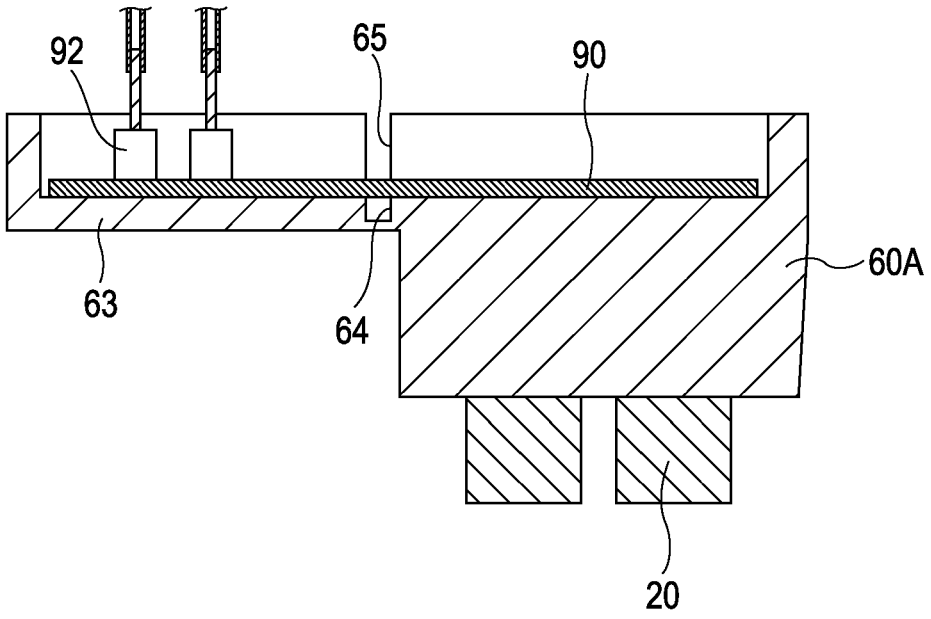
FIGS. 11A and 11B are cross-sectional views of a head unit according to a second embodiment of the invention.
Figure 11B:
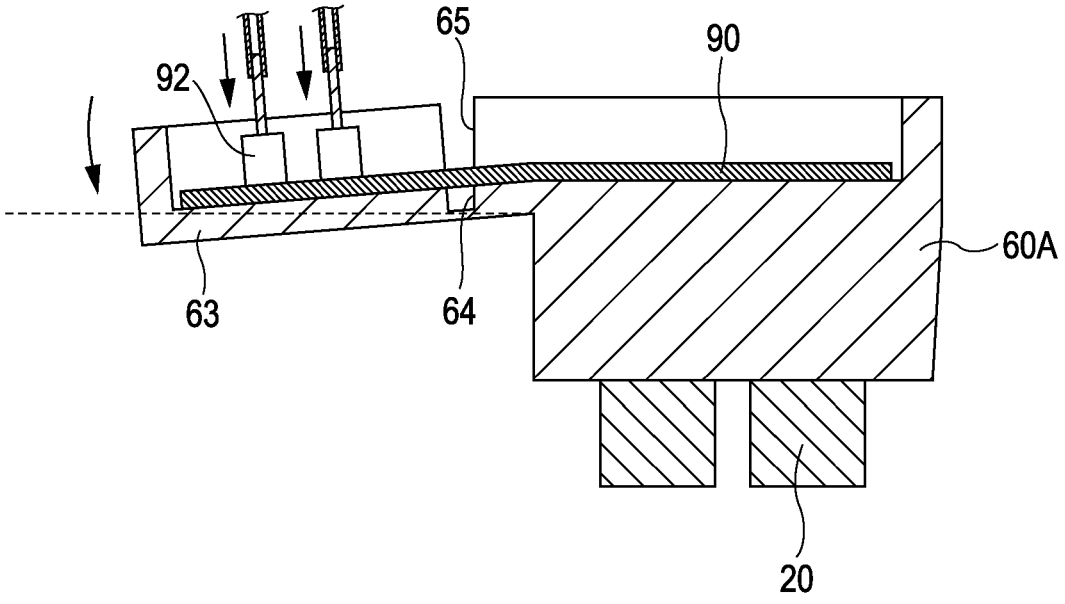

As illustrated in FIGS. 11A and 11B, a thin wall portion 64 is formed at a boundary between the extending portion 63 oppositely disposed relative to the connector 92 of a case 60A and a region where the recording head 20 is secured by forming a groove therebetween. A thickness of the boundary between the extending portion 63 and the region where the recording head 20 is secured is reduced by forming the thin wall portion 64. The stiffness of the boundary between a region where the extending portion 63 is oppositely disposed relative to the connector 92 of the case 60A and the region where the recording head 20 is secured is reduced by thus providing the thin wall portion 64 to the case 60A. Hereby, although the portion, where the connector 92 of the circuit substrate 90 is disposed, is elastically deformed by force applied thereto, as illustrated in FIG. 11B, when the external wiring is connected to the connector 92 or disconnected therefrom, it becomes possible to restrain the region where the recording head 20 of the case 60A is secured from undergoing deleterious effects of force applied thereto by downwardly displacing only the extending portion 63. Incidentally, as illustrated in FIG. 1, since a wall is upwardly disposed along the inner exterior of the extending portion 63 of the case 60 relative to the ink supply needle 100, a slit 65 that is continuous with the thin wall 64 can be further provided to the wall; thereby, it becomes possible to deflectively deform only the extending portion 63 of the case 60 with more ease by providing the aforementioned slit 65 thereto.

Additionally, the circuit substrate 90 may be arranged so as not to abut against the extending portion 63 of the case 60 when the circuit substrate 90 is elastically deformed. Such an example of the another embodiment of the invention as described above is illustrated in FIGS. 12A and 12B. Here, FIGS. 12A and 12B are cross-sectional views of substantial parts of a head unit according to the another embodiment of the invention.

Figure 12A:
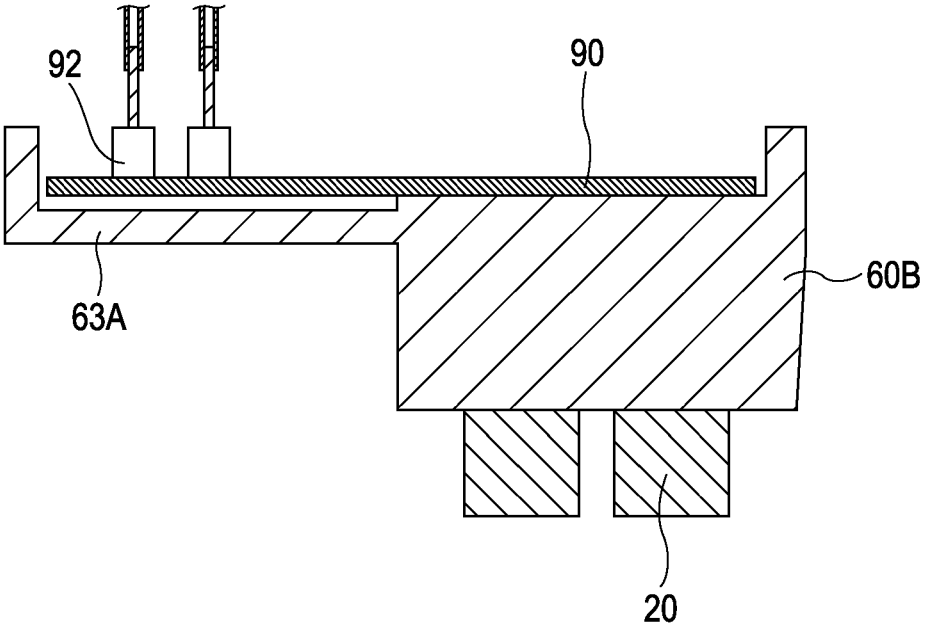
FIGS. 12A and 12B are cross-sectional views of the head unit according to a third embodiment of the invention.
Figure 12B:
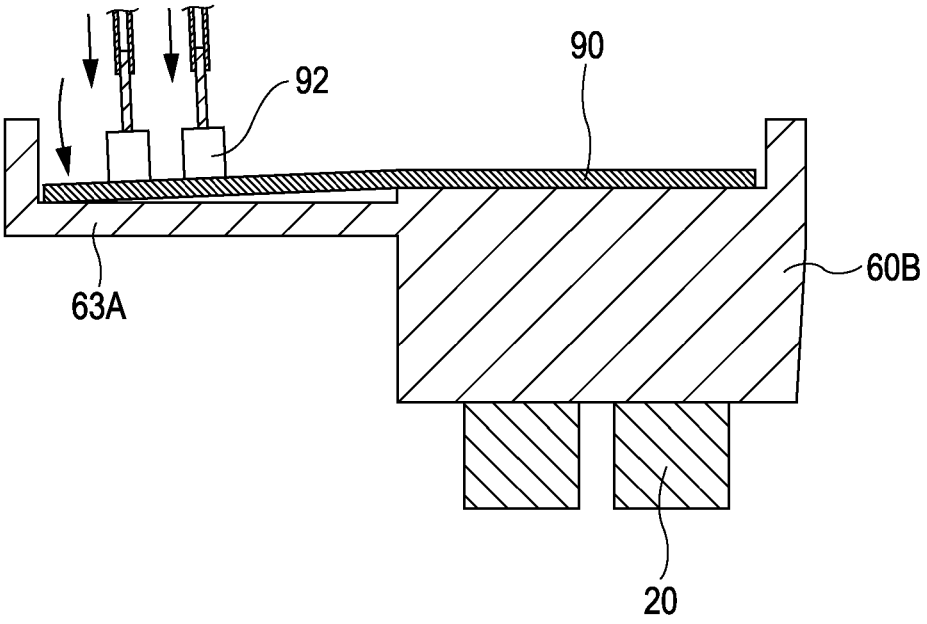

As illustrated in FIGS. 12A and 12B, a case 60B is provided with a space formed between an extending portion 63A and the circuit substrate 90. As illustrated in FIG. 12B, the portion of the connector 92 of the circuit substrate 90 is elastically deformed by force applied thereto when the external wiring is connected to the connector 92 or disconnected therefrom; however, such the case 60B as described above is capable of restraining a region where the recording head 20 of the case 60B is secured from undergoing deleterious effects of force applied thereto, because the circuit substrate 90 will not abut against the extending portion 63A due to the space formed between the extending portion 63A and the circuit substrate 90. Further, even though the circuit substrate 90 abuts against the extending portion 63A in consequence of the elastically deformed portion of the connector 92 of the circuit substrate 90, the aforementioned deleterious effects of force, which are caused by connecting and disconnecting the external wiring to and from the connector 92, can be suppressed due to a decreased abutting force that is achieved by such the space as described above. It is obvious to those skilled in the art that the thin wall portion 64 illustrated in FIGS. 11A and 11B may be combined with the space illustrated in FIGS. 12A and 12B as a matter of course.

In addition to the above, according to the first embodiment of the invention as described above, the head units 10 are provided with the first projecting portion 11, the second cut-off portion 14, the second projecting portion 13 and the first cut-off portion 12 disposed at both ends of the individual head units 10 in the first direction Y. However, without being particularly limited thereto, the first head unit 10A may be provided with only the first projecting portion 11 and the second cut-off portion 14 at the end opposite to the second head unit 10B, and the second head unit 10B may be likewise provided with only the second projecting portion 13 and the first cut-off portion 12 at the end opposite to the first head unit 10A, in a case where the two head units 10A and 10B are disposed side by side in the first direction Y according to the first embodiment of the invention, as described above. In other words, the two head units 10 disposed in contiguous relation to each other may be respectively provided with the projecting portion and the cut-off portion which are disposed at only the ends opposite to each other. Incidentally, cost can be reduced by mass-producing the similarly shaped head units 10 in comparison with manufacturing of differently shaped head units by disposing the first projecting portion 11, the second cut-off portion 14, the second projecting portion 13 and the first cut-off portion 12 at both ends of the individual head units 10 as described above. What is more, an arrangement of the head units 10 is not limited thereto, and more than or equal to three head units 10 can be disposed side by side in the first direction Y by disposing the projecting portions and the cut-off portions at both ends of the individual head units 10. Incidentally, according to the first embodiment of the invention as described above, the projecting portions and the cut-off portions are respectively disposed at both ends of the individual head units 10 in the first direction Y in such manner that both ends of the head units 10A and 10B are of rotationally symmetric configuration in the first direction Y; hereby, the two head units 10 can be further disposed in mating relation to each other by rotating the head units 10, even though a first pair of the first projecting portion 11 and the first cut-off portion 12 is replaced with a second pair of the second projecting portion 13 and the second cut-off portion 14. However, it is preferable that directions, in which the head units 10 are secured to the fixing member 210, be unified into one direction regardless of the rotationally symmetric configuration thereof in such a case where the head units 10 are manufactured in consideration of the direction in which the head units 10 are secured to the fixing member 210 or the like when a variation occurs in ejecting characteristics of the recording heads 20 according to manufacturing conditions thereof or the like.

Further, according to the first embodiment of the invention as described above, the fluid passage member 80 that includes the main body of the fluid passage member 81 and the cover 82 is exemplified; however, a configuration of the fluid passage member 80 is not particularly limited thereto. For instance, a fluid passage member may be integrally formed with a main body of the fluid passage member and a cover.

Further more, according to the embodiments of the invention as described above, thin-film piezoelectric elements are exemplified as pressure generating elements; however, a configuration of pressure generating elements is not particularly limited thereto. For instance, thick-film piezoelectric elements formed by a method of bonding a green sheet thereto or the like, longitudinal vibration piezoelectric elements, which retract and return to an original position in an axial direction by alternately laminating piezoelectric material layers and electrode-forming material layers or the like, may be further used for the pressure generating elements. Still further more, a droplet ejection device that ejects liquid droplets through nozzles thereof by bubbles formed by generated heat of heating elements disposed in a pressure generating chamber, a so-called electrostatic actuator that ejects liquid droplets through nozzles thereof by a vibrating plate deformed by electrostatic force generated between the vibrating plate and an electrode or the like may be further used as the pressure generating elements.

In addition to the above, according to the embodiments of the invention as described above, the ink jet recording head has been described as one example of the liquid ejecting head; however, it should be understood that the invention relates to an overall liquid ejecting head module provided with the liquid ejecting head in a broad meaning. The invention, therefore, may be further applicable to the liquid ejecting head modules that includes, e.g., various recording heads used for an image recording apparatus such as a printer or the like, a color material ejecting head used for manufacturing a color filter of a liquid crystal display or the like, an electrode material ejecting head used for forming an electrode of an organic EL display, an FFD, i.e., a field emission display, or the like, and a bioorganic material ejecting head used for manufacturing a bio chip or the like.

What is claimed is:

1. A liquid ejection head module comprising:

a first head unit having a plurality of nozzles;

a second head unit having a plurality of nozzles;

a first projecting portion on outer shape of the first head unit, the first projecting portion projecting toward the second head unit;

a second projecting portion on outer shape of the second head unit, the second projecting portion projecting toward the first head unit;

a connector disposed on each of the head units, each connector being electrically connectable to an external wiring with a connecting port thereof; and an extending portion on each of the outer shape of the first and second head unit;

wherein the first and second head units are in a mutually mated condition to perform printing longitudinally along the first and second head units in a first direction, the extending portion extends outwardly in a second direction crossing the first direction, and each connector is disposed so that the connecting port is open at a side opposite from a liquid ejecting side where each aperture of the nozzles is open.

2. The liquid ejecting head module according to claim 1, wherein the each connector is disposed on exterior of the nozzles in the second direction.

3. The liquid ejecting head module according to claim 2, further comprising:

a third head unit having a plurality of nozzles; and a third connector disposed on the third head unit, the third connector being electrically connectable to an external wiring with a connecting port thereof;

wherein the third head unit is disposed in overlapping relation to the first head unit in the first direction, and the third connector is disposed in overlapping relation to either one of the connectors of the first and second head unit in the second direction.

4. The liquid ejecting head module according to claim 1, further comprising:

a third head unit disposed in overlapping relation to the first head unit in the first direction.

5. The liquid ejecting head module according to claim 1, further comprising:

a filter for removing air bubbles from liquid in each of the head units.

6. The liquid ejecting head module according to claim 1, further comprising:

filters for removing air bubbles from liquid in the first head units, the filters are disposed in overlapping relation to each other in the second direction.

7. The liquid ejecting head module according to claim 1, wherein the first and second head units are of rotationally symmetric configuration.

8. The liquid ejecting head module according to claim 1, wherein a thin wall portion is formed at a boundary in the each head between a region where the each connector is disposed and a side where the each aperture is open, and the thin wall portion has a wall thickness smaller than those of another regions.

9. The liquid ejecting head module according to claim 1, wherein a space is formed between each holder and a substrate on which each connector is disposed.

10. The liquid ejecting head module according to claim 1, wherein each of the first and second head units has a plurality of liquid ejecting heads.

11. The liquid ejecting head module according to claim 1, wherein the extending portion is configured to be elastically deformable relative to regions where the nozzles are provided.

12. The liquid ejecting head module according to claim 11, wherein the extending portion is configured to decrease a force caused by connecting and disconnecting the external wiring to and from the connector, the force having effect on the regions where the nozzles are provided.

* * * * *